US008890758B2

(12) United States Patent
Asplund et al.

(10) Patent No.: US 8,890,758 B2
(45) Date of Patent: Nov. 18, 2014

(54) ANTENNA ARRANGEMENT

(75) Inventors: Henrik Asplund, Stockholm (SE); Anders Derneryd, Göteborg (SE); Fredrik Harrysson, Göteborg (SE); Jonas Medbo, Uppsala (SE)

(73) Assignee: Telefonaktiebolaget L M Ericsson, Stockholm (SE)

( * ) Notice: Subject to any disclaimer, the term of this patent is extended or adjusted under 35 U.S.C. 154(b) by 167 days.

(21) Appl. No.: 13/576,952

(22) PCT Filed: Feb. 9, 2010

(86) PCT No.: PCT/SE2010/050150

§ 371 (c)(1),
(2), (4) Date: Aug. 3, 2012

(87) PCT Pub. No.: WO2011/099901

PCT Pub. Date: Aug. 18, 2011

(65) Prior Publication Data

US 2012/0306711 A1 Dec. 6, 2012

(51) Int. Cl.

| | |
|---|---|
| ***H01Q 13/00*** | (2006.01) |
| ***H01Q 13/10*** | (2006.01) |
| ***H01Q 13/20*** | (2006.01) |

(52) U.S. Cl.

CPC ..... *H01Q 13/203* (2013.01)
USPC ..... 343/776; 343/770; 343/771

(58) Field of Classification Search

CPC ..... H01Q 13/203; H01Q 13/00; H01Q 13/20
USPC ..... 343/770, 771, 776; 333/237
See application file for complete search history.

(56) References Cited

U.S. PATENT DOCUMENTS

| | | | | |
|---|---|---|---|---|
| 3,281,591 | A | 10/1966 | Takeya | |
| 5,247,270 | A * | 9/1993 | Harman et al. | 333/237 |
| 5,546,096 | A * | 8/1996 | Wada | 343/771 |
| 5,705,967 | A * | 1/1998 | Pirard | 333/237 |
| 2010/0194500 | A1 * | 8/2010 | Suzuki et al. | 333/237 |

FOREIGN PATENT DOCUMENTS

| | | | |
|---|---|---|---|
| CN | 101300715 | A | 11/2008 |
| FR | 2652453 | A1 | 3/1991 |
| JP | 2004135159 | A | 4/2004 |
| JP | 2005190896 | A | 7/2005 |
| KR | 20070087927 | A | 8/2007 |

* cited by examiner

*Primary Examiner* — Hoang V Nguyen
(74) *Attorney, Agent, or Firm* — Murphy Bilak & Homiller PLLC

(57) ABSTRACT

An antenna (100,200,300, 400, 500) comprising first (110, 210, 310, 410, 430) and second (120, 220, 320, 420, 440) structures for guiding electromagnetic waves, each comprising groups (111, 130, 150, 230, 330; 140,160, 240, 340, 445, 470) of radiation elements. For adjacent sections in 5 the structures, at least one applies: ?Groups of radiation elements are distributed along the two structures such that a group (110, 130, 150) in the first structure overlaps a group (120, 140,160) in the second structure partially or not at all. ?Radiation elements within said groups (230; 240) exhibit a common 10 main direction of extension within the group, and differs between the first and the second groups by an angle of at least 10 degrees. ?The radiation elements of the groups (330, 340) are distributed along the structures (310, 320) on sides of the structures which face different directions.

12 Claims, 3 Drawing Sheets

ANTENNA ARRANGEMENT

TECHNICAL FIELD

The present invention discloses a novel antenna arrangement.

BACKGROUND

When deploying wireless communications systems such as, for example, cellular systems, in indoor environments in general, traditional kinds of antennas can be difficult to use. In such environments, use is sometimes instead made of so called "leaky cables", also sometimes referred to as leaky feeders or radiating cables.

A leaky cable is, as the name implies, a cable which is capable of conducting electrical energy, and which has been provided with apertures in order to make the cable radiate, i.e. to allow some of the energy to "leak" from the cable, thus enabling the cable act as an antenna. Such an antenna, i.e. a leaky cable, will be able to act as both a receiving and a transmitting antenna. Due to its nature of a cable, a "leaky cable antenna" will, as compared to a traditional antenna, act more like a line source than a point source, thus making it easier to obtain coverage in tunnels or where a high degree of "shadowing" occurs when using a point source antenna. An example of the latter is an indoor scenario, e.g. an office landscape.

U.S. Pat. No. 4,091,367 and U.S. Pat. No. 5,247,270 disclose leaky cable systems which are intended for use as intruder detection systems, with the disclosure of the latter document being particularly intended for burial below ground or for use in mines.

SUMMARY

It is an object of the present invention to provide an antenna arrangement with leaky cables which has improved properties as compared to the prior art.

Such an antenna arrangement is offered by the present invention in that it discloses an antenna arrangement which comprises a first and a second elongated structure for guiding an electromagnetic wave. Each of the structures exhibits a longitudinal and a transversal direction of extension and are positioned alongside each other in their longitudinal direction of extension. In addition, each of the structures comprises at least one group of radiation elements.

According to the invention, the first and second structures are arranged so that for at least two adjacent sections, one in each structure, at least one of the following applies:

- The groups of radiation elements are distributed along the two structures such that a group in the first structure overlaps a group in the second structure partially or not at all.
- The radiation elements within said groups exhibit a main direction of extension which is common within the group, and differs between the first and the second groups by an angle of at least 10 degrees.
- The radiation elements of the groups are distributed along the structures on sides of the structures which face different directions.

An advantage of the invention is thus that the inventive antenna arrangement can be used for transmit and/or receive diversity between the two structures, with several kinds of diversity being possible in the inventive antenna arrangement, such as for example space diversity, polarization diversity and diversity due to differing radiation patterns, as will be realized from the detailed description given below.

A further advantage of the invention is that the correlation between the two structures can be kept low, which means that the antenna arrangement of the invention can also be used for so called MIMO applications, Multiple Input Multiple Output. MIMO is a technology which is becoming increasingly common, and which needs at least two channels (e.g. two antennas) with a low degree of correlation between them.

Yet a further advantage is that the spatial separation of the radiation elements in the transversal direction can be decreased as compared to prior art, which is advantageous since the amount of space available for such arrangements in, for example, office landscapes, is usually limited.

In one embodiment of the invention, both the first and the second structure comprise a plurality of groups of radiation elements, which radiation elements exhibit a main direction of extension which is common within the structure, with the groups in each structure being equidistantly spaced along the longitudinal directional of extension of the structure.

In one embodiment of the invention, the radiation elements of said groups are spaced equidistantly within said groups along the longitudinal directional of extension of the structure.

In one embodiment of the invention, the groups of radiation elements in the structures are arranged at a minimum longitudinal distance to the nearest group of radiation elements in the other structure.

In one embodiment of the invention, the radiation elements of the groups are distributed along the structures on sides of the structures which face different directions with a difference between said directions in the interval of 150 to 210 degrees as seen in the radial direction of the structures.

In one embodiment of the invention, the first and second structures are arranged so that their longitudinal directions of extension are in parallel with each other.

In one embodiment of the invention, the first and second structures are one of the following:

- a coaxial cable,
- a waveguide
- a strip line arrangement,
- a micro strip arrangement.

In one embodiment of the invention, the radiation elements are through-going apertures in a conductor in the first and second structure.

In one embodiment of the invention, the antenna arrangement comprises a locking arrangement for locking the first and the second structures in a predetermined position relative to each other with respect to their longitudinal extensions as well as to a distance between the structures and/or a radial rotation between the structures.

In one embodiment of the invention, the locking arrangement comprises a sheathing of a non-conducting material surrounding each of said first and second structures.

BRIEF DESCRIPTION OF THE DRAWINGS

The invention will be described in more detail in the following, with reference to the appended drawings, in which.

DETAILED DESCRIPTION

The invention will be described below with reference to the accompanying drawings, in which the structures for guiding an electromagnetic wave are shown as coaxial cables. It should however be pointed out that this is merely an example intended to enhance the reader's understanding of the invention and should not be seen as limiting the choice of structure, which can, for example, also comprise one or more of the following:

waveguides, strip line arrangements, micro strip arrangements.

Also, the invention will be described by means of examples which comprise two structures or cables, which will also be referred to as "antennas". Again, the number of cables shown is merely an example intended to enhance the reader's understanding of the invention, and should not be seen as limiting the number of cables which can be used within the scope of the present invention.

Figure 1:
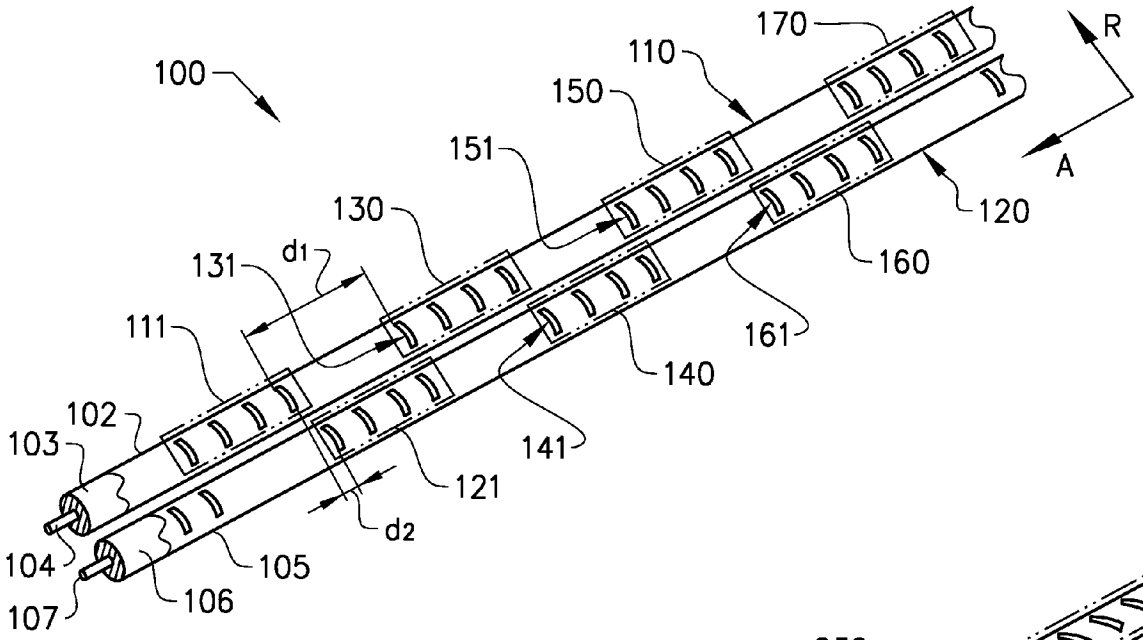
FIG. 1 shows a first example of an embodiment of the invention which provides spatial diversity.

Turning now to FIG. 1, there is shown a first example of an embodiment 100 of the invention which is intended to provide so called spatial diversity between two cables, i.e. two "antennas", which is a manner in which the two cables or structures will also be referred to from now on.

As shown, the embodiment 100 comprises a first 110 and a second 120 coaxial cable, each of which comprises an inner conductor 104, 107 and an outer conductor 102, 105, which are separated from the respective inner conductor by a dielectric layer 103, 106. An alternative to a dielectric layer is a dielectric spacer, i.e. a spacer of a dielectric material. The first cable 110 comprises groups 111, 130, 150, 170 of radiation elements with at least one radiation element 131, 151, in each group, and the second cable 120 also comprises groups 140, 160, of radiation elements with at least one radiation element 141, 161, in each group. For reasons of clarity, not all of the radiation elements in FIG. 1 have been provided with reference numbers.

The radiation elements of the embodiment 100 are elongated slots which are through-going perforations in the outer conductor 102, 105, and have a main direction of extension which makes the slots radiate. The main direction of extension is suitably the same for all of the slots in one and the same group, and is preferably in this embodiment also the same between all of the groups in one and the same cable. The term "main direction of extension" is used here, since a slot will also have a "secondary" or "crosswise" direction of extension.

The main direction of extension which makes a slot radiate differs between different kinds of cables: in a coaxial cable, as shown in the drawings, the main direction of extension should not coincide with the cable's main length of extension. A suitable deviation is 10 degrees or greater. In a wave guide, or a micro strip or strip line structure, the main direction of extension of a slot can coincide with that of the structure or cable and still radiate.

Regarding the exact shape of the radiation elements, it should be pointed out that although they are shown as elongated slots in the drawings and referred to in this way in the majority of the description, the shape of the radiation elements can be chosen from a wide variety of different kinds of perforations in the outer conductor, although preferred embodiments include elongated rectangular or oval slots. It should however be pointed out that most shapes of perforations will give rise to a radiating effect. Also, with reference to other kinds of possible structures for guiding an electromagnetic wave, such as waveguides or strip line and micro strip structures, it can be pointed out that the perforations which form the radiation elements should be made in the conductor of such structures.

Also shown in FIG. 1 is a coordinate system which indicates an axial, A, and a radial, R, direction of extension of the two cables 110, 120, which in this example are arranged so that their axial extensions are essentially in parallel to each other.

As can be seen, in the embodiment 100, each group of radiation elements in a cable is spaced apart from immediately neighbouring groups in the same cable by a minimum distance of $d_1$, which is suitably designed so as to be at least the extension of a group of radiation elements.

As can be seen in FIG. 1, in the embodiment 100, the closest longitudinal distance between the outer edges of two groups of radiation elements, one in each cable, is kept above a minimum distance $d_2$, which is shown in FIG. 1. The principle employed in the embodiment which gives spatial diversity is that the groups of radiation elements in the two structures are distributed along the two structures in such a manner that a group in one structure overlaps a group in the other structure partially or not at all, the latter being the case in the embodiment shown in FIG. 1, with the longitudinal separation between groups in the two structures being at least $d_2$.

As can be seen in FIG. 1, the term "overlap" is here used to mean that the minimum distance $d_2$ between two radiation elements in the two cables is preferably such that no point in a radiation element in one cable is arranged in a perpendicular direction from a point in a radiation element in the other cable.

By means of the embodiment 100 and its arrangement of groups of radiation elements, if one and the same data stream D1 is transmitted through each of the cables 110, 120, the embodiment 100 will give rise to a low degree of spatial correlation between the signals emitted from the two cables, thus giving rise to so called spatial diversity.

In addition, the embodiment 100 can also be used as an antenna for MIMO applications, Multiple Output Multiple Input. In MIMO applications, two different data streams $D_1$ and $D_2$ will be transmitted, one in each cable 110, 120, or both streams can be transmitted in both cables 110, 120, if the appropriate gain and/or phase weighting of the data streams is applied. MIMO is a technology which relies on a high degree of de-correlation between multiple transmitted (or received) data streams, and for this reason, the embodiment 100 is highly suitable for MIMO applications, since the groups of radiation elements arranged as described above and shown in FIG. 1 will give rise to a high degree of de-correlation between the signals transmitted from the two cables 110,120.

Figure 2:
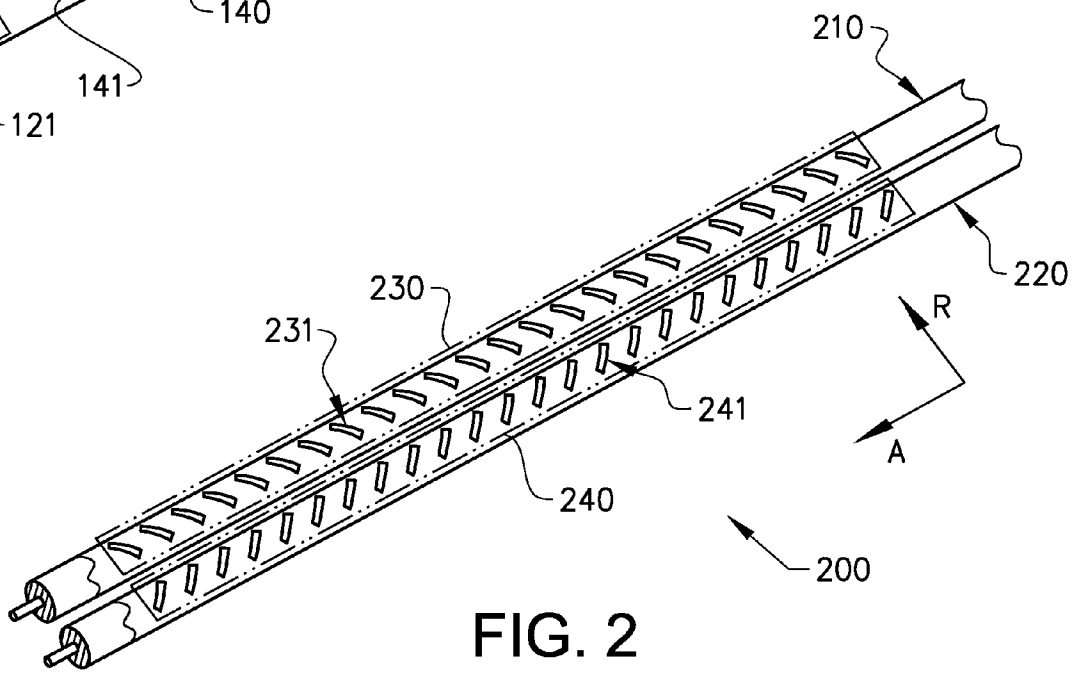
FIG. 2 shows a second example of an embodiment of the invention which provides polarization diversity.

FIG. 2 shows a second embodiment 200 of the invention, intended to provide diversity between two cables 210, 220, by means of so called polarization diversity. FIG. 2 shows one group 230, 240, of radiation elements in each cable 210, 220, which of course is only an example. Only one radiation element 231, 241 in each group has been given a reference number, for reasons of clarity.

In the embodiment 200, the radiation elements are shown as elongated slots, but as opposed to the embodiment 100 of FIG. 1, in the embodiment 200 the radiation elements 231, 241 of one cable 210, 220 are arranged so that they have a main direction of extension which is common within the group but which differs from the main direction of extension of at least the closest group in the other cable by at least a predefined angle, at least 10 degrees, although a difference of 90 degrees is even more preferred, since such an angle will give rise to directions of polarization which are orthogonal between the two cables 210, 220. Suitably, all groups in each cable have a common direction of extension.

In a preferred embodiment of the "polarization diversity" embodiment, all radiation elements in a cable 210, 220, are essentially parallel to each other, as shown in FIG. 2.

If one and the same data stream D1 is transmitted through each of the cables 210, 220, the embodiment 200 will give rise to signals with differing polarizations from the two cables 210, 220, thus causing so called polarization diversity. The difference between the polarizations between the signals from the two cables 210, 220, will essentially correspond to the angle between the radiation elements in the two cables.

In addition, the embodiment 200 can also be used as an antenna for MIMO applications, Multiple Output Multiple Input. In MIMO applications, different data streams $D_1$ and $D_2$ will be transmitted, one in each of the cables 210, 220. As mentioned previously, MIMO is a technology which relies on a high degree of de-correlation between multiple transmitted (or received) data streams, which is a condition which will be fulfilled by the embodiment 200, thus making it highly suitable for MIMO applications.

Figure 3B:
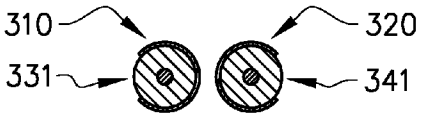
FIGS. 3*a* and 3*b* show two views of a third example of an embodiment of the invention which provides radiation pattern diversity.
Figure 3A:
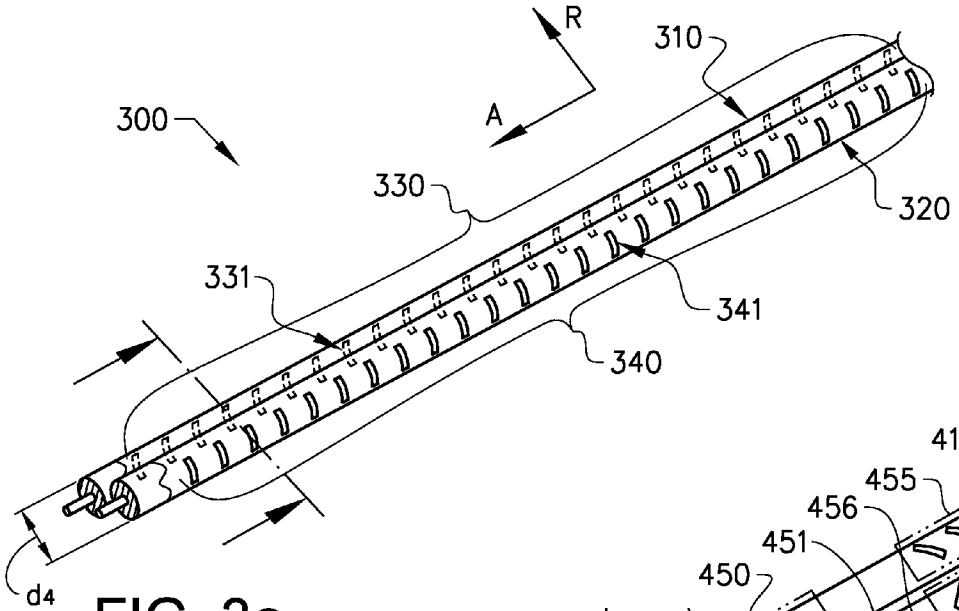

FIG. 3*a* shows a third embodiment 300 of an antenna arrangement of the invention. Only one group 330, 340 of radiation elements is shown in each cable 310, 320, which again is merely an example. Also, as an example, the radiation elements 331, 341 in the two cables 310, 320 are shown as elongated slots, arranged equidistantly within each group.

The embodiment 300 also gives rise to diversity between the signals emitted from the two cables or antennas 310, 320, shown in FIG. 3*a*. However, in this embodiment, the diversity is a diversity caused by two cables 310, 320 which can have essentially similar radiation patterns or antenna diagrams, since the cables are arranged so that the radiation elements 331, 341, of the two cables 310, 320, are distributed along the structures on sides of the structures which face different directions. The expression "face different directions" is exemplified in FIGS. 3*a* and 3*b* as being directions which differ 180 degrees in the radial direction of the two structures, said 180 degrees in FIGS. 3*a* and 3*b* being such that the different directions are sideways from the arrangement 300, as shown in FIGS. 3*a* and 3*b*. However, in other embodiments, the difference of 180 degrees can also be used to let the radiation elements face in other differing directions, such as, for example, "up" and "down", these directions being defined with relation to how the structures are shown in FIG. 3*b*. In addition, the condition of facing in different directions is also employed by the invention with the angular difference being other than 180 degrees, but preferably in the interval of 150 to 210 degrees.

The difference of 180 degrees can also be expressed as saying that the cables 310, 320, are arranged so that their respective radiation elements 331, 341, are at a maximum radial distance $d_4$ from each other, or that the cables 310, 320, are arranged so that their respective radiation elements face away from each other in the radial directions of the cables.

Thus, signals transmitted from the two cables 310, 320, will be de-correlated with respect to each other by means of their radiation patterns pointing in different directions. This will also make the embodiment 300 suitable for MIMO applications.

Figure 4:
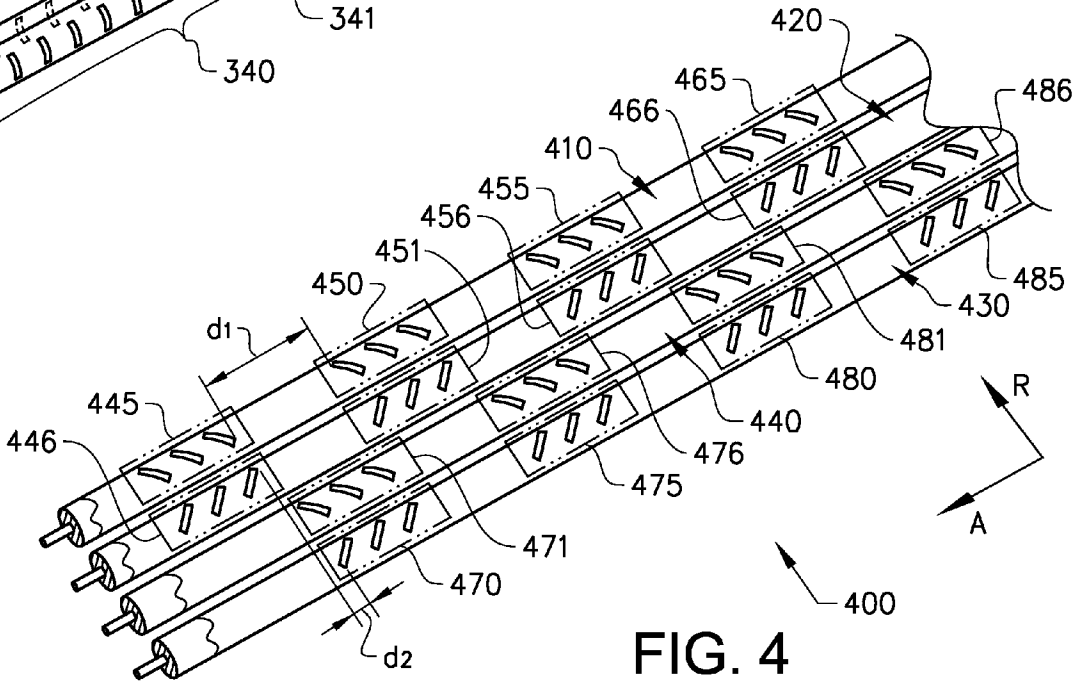
FIG. 4 shows a fourth example of an embodiment of the invention which provides combined kinds of diversity.

Naturally, the methods described above and shown in FIGS. 1-3 of achieving diversity can be combined with each other in order to obtain an even higher degree of de-correlation between transmitted signals. One example of such combining is shown in FIG. 4, which shows an antenna arrangement 400 which comprises four individual cables 410, 420, 430, 440. The cables of the arrangement 400 follow the design shown in FIG. 2 pair-wise, i.e. a first pair of cables 410, 420 and a second pair of cables 430, 440 comprise groups of radiation elements, which groups within each pair of cables follow the principle that the radiation elements of the groups in one cable in the cable pair are parallel to each other and at an angle, here 90 degrees, with respect to the radiation elements of the group of radiation elements in the other cable in the cable pair. Also, the groups of radiation elements in one cable pair are arranged so that each group's centre point essentially coincides with that of a group in the other cable in the cable pair Thus, the arrangement of FIG. 4 will give rise to polarization diversity within a cable pair. However, since the groups of radiation elements of one cable pair are arranged according to the principle of FIG. 1 with respect to the groups of radiation elements in the other cable pair, the arrangement of FIG. 4 will also give rise to spatial diversity between the cable pairs. Since the principle of FIG. 1 is used between the cable pairs, there is a minimum distance $d_2$ between the groups of radiation elements in the cable pairs as well as an axial minimum distance $d_1$ between the radiation elements in a group. Thus, the arrangement 400 will give rise to polarization diversity within the cable pairs 410-420 and 430-440 as well as space diversity between the cable pairs.

Naturally, the combination shown in FIG. 4 is only an example, the embodiments shown in FIGS. 1-3 can be combined in a wide variety of other ways, particularly if more than two cables are used.

Figure 5:
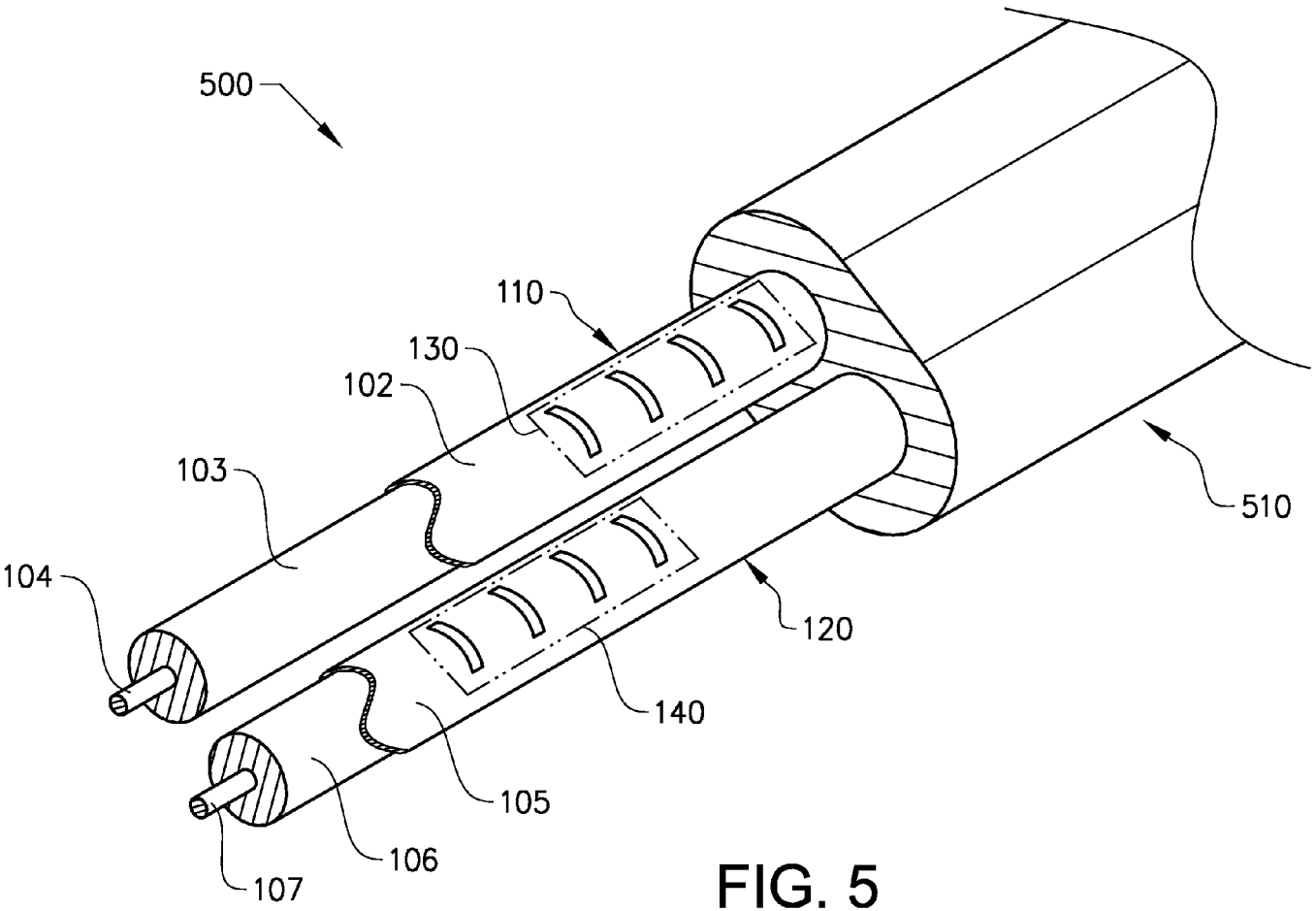
FIG. 5 shows a fifth example of an embodiment of the invention.

FIG. 5 shows an antenna arrangement 500 which can be applied to any of the embodiments shown in FIGS. 1-4, but which is here shown applied to the embodiment 100 of FIG. 1: in order to ensure the proper distances and angles between the cables 110, 120 in the antenna arrangement 100, the cables 110, 120 are locked in their positions with respect to each other by a locking means 510. The locking means 510 can be designed in a number of ways, such as, for example interacting protrusions in one of the cables and interacting apertures in the other cable, locking bands or hook and loop type fasteners. Suitably, these locking means assume that each cable is surrounded by a protective non-conducting sheathing, such as a rubber sheathing.

The locking means 510 in the arrangement of FIG. 5 is however different from the ones listed above: instead, the cables 110, 120 shown in FIG. 5 are encased in a piece of dielectric material 510 which locks them in place, i.e. there is a sheathing of a non-conducting material surrounding each of the cables. Another way of achieving the same goal is to have each cable surrounded by a non-conducting sheathing, and to then have a common non-conducting sheathing for locking the cables in position.

As has been mentioned, the degree of correlation between the signals transmitted/received from/by the cables in an arrangement of the invention should be below a predefined threshold. This threshold is naturally a design parameter, but a preferred maximum degree of correlation is 0.7.

Also, it should be pointed out that although the arrangement of the invention has been described above primarily with reference to transmission, the inventive arrangement works equally well for reception, and will thus be able to be used for diversity or MIMO reception.

It can also be noted, with reference for example, to the embodiment shown in FIG. 1, that the minimum distance $d_2$ from at least one group of radiation elements in the two structures to the closest radiation element in the other structure is above a predefined minimum distance can also be such that there is a degree of "overlap" between one group in each of the structures 110, 120, such as for example the groups 111, 121. Such a design will cause degradation in the degree of de-correlation, but is still within the scope of the present invention. Another alternative design which will also cause degradation in the degree of de-correlation is to arrange smaller apertures or radiation elements directly opposite a group of radiation elements such as, for example, the groups 111, 121. Such smaller apertures could for example be in the shape of small holes.

The invention is characterized by the features shown above, which are also outlined in the appended patent claims. By means of the design of the present invention, at least two parallel sections, one in each of the two structures for guiding an electromagnetic wave, can be found which fulfil one or more of the following during transmission:

One of the sections emits more radiation than the other,

The two sections radiate with different polarizations,

The two sections radiate in different directions.

The invention is not limited to the examples of embodiments described above and shown in the drawings, but may be freely varied within the scope of the appended claims.

The invention claimed is:

1. An antenna arrangement comprising a first and a second elongated structure for guiding an electromagnetic wave, each of said structures exhibiting a longitudinal and a transversal direction of extension, said structures being positioned alongside each other in their longitudinal direction of extension, each of said structures comprising at least one group of radiation elements, and wherein the first and second structures are arranged so that for at least two adjacent sections, one in each structure, at least one of the following applies:

the groups of radiation elements are distributed longitudinally along the two structures such that no group in either structure more than partially overlaps any group in the other structure; and the radiation elements of the groups are distributed along the structures on sides of the structures which face different directions.

2. The antenna arrangement of claim 1, in which both the first and the second structure comprise a plurality of groups of radiation elements, which radiation elements exhibit a main direction of extension which is common within the structure, with the groups in each structure being equidistantly spaced along the longitudinal directional of extension of the structure.

3. The antenna arrangement of claim 1, in which the radiation elements of said groups are spaced equidistantly within said groups along the longitudinal directional of extension of the structure.

4. The antenna arrangement of claim 1, in which the first and second structures are arranged so that their longitudinal directions of extension are in parallel with each other.

5. The antenna arrangement of claim 1, in which the first and second structures are one of the following: a coaxial cable, a waveguide, a strip line arrangement, or a micro strip arrangement.

6. The antenna arrangement of claim 5, in which the radiation elements are through-going apertures in a conductor in the first and second structure.

7. The antenna arrangement of claim 1, further comprising a locking arrangement for locking the first and the second structures in a predetermined position relative to each other with respect to their longitudinal extensions as well as to at least one of: a distance between the structures, and a radial rotation between the structures.

8. The antenna arrangement of claim 7, in which the locking arrangement comprises a sheathing of a non-conducting material surrounding each of said first and second structures.

9. The antenna arrangement of claim 8, in which the locking arrangement comprises one or more of the following: interacting protrusions in one of the cables and interacting apertures in the other cable, locking bands, and hook and loop type fasteners.

10. The antenna arrangement of claim 1, wherein the closest longitudinal distance between the outer edges of two groups of radiation elements, one in each cable, is kept above a minimum distance.

11. An antenna arrangement comprising a first and a second elongated structure for guiding an electromagnetic wave, each of said structures exhibiting a longitudinal and a transversal direction of extension, said structures being positioned alongside each other in their longitudinal direction of extension, each of said structures comprising at least one group of radiation elements, and wherein the first and second structures are arranged so that for at least two adjacent sections, one in each structure, at least one of the following applies:

the groups of radiation elements are distributed along the two structures such that a group in the first structure overlaps a group in the second structure partially or not at all; and the radiation elements of the groups are distributed along the structures on sides of the structures which face different directions; and wherein the groups of radiation elements in said structures are arranged at a minimum longitudinal distance to the nearest group of radiation elements in the other structure.

12. An antenna arrangement comprising a first and a second elongated structure for guiding an electromagnetic wave, each of said structures exhibiting a longitudinal and a transversal direction of extension, said structures being positioned alongside each other in their longitudinal direction of extension, each of said structures comprising at least one group of radiation elements, and wherein the first and second structures are arranged so that for at least two adjacent sections, one in each structure, at least one of the following applies:

the groups of radiation elements are distributed along the two structures such that a group in the first structure overlaps a group in the second structure partially or not at all; and the radiation elements of the groups are distributed along the structures on sides of the structures which face different directions; and wherein the radiation elements of the groups are distributed along the structures on sides of the structures which face different directions with a difference between said directions in the interval of 150 to 210 degrees as seen in the radial direction of the structures.

* * * * *

UNITED STATES PATENT AND TRADEMARK OFFICE

CERTIFICATE OF CORRECTION

PATENT NO. : 8,890,758 B2
APPLICATION NO. : 13/576952
DATED : November 18, 2014
INVENTOR(S) : Asplund et al.

It is certified that error appears in the above-identified patent and that said Letters Patent is hereby corrected as shown below:

On the Title Page, in item (73), under "Assignee", in Column 1, Line 1, delete "Stockholm" and insert -- (publ.), Stockholm --, therefor.

Signed and Sealed this
Twenty-ninth Day of September, 2015

Michelle K. Lee

Michelle K. Lee
*Director of the United States Patent and Trademark Office*